United States Patent [19]

Bulso, Jr. et al.

[11] Patent Number: 4,713,958

[45] Date of Patent: Dec. 22, 1987

[54] METHOD AND APPARATUS FOR FORMING CONTAINER END PANELS

[75] Inventors: Joseph D. Bulso, Jr., Canton; James A. McClung, North Canton, both of Ohio

[73] Assignee: Redicon Corporation, Canton, Ohio

[21] Appl. No.: 924,835

[22] Filed: Oct. 30, 1986

[51] Int. Cl.[4] ..... B21D 51/44

[52] U.S. Cl. ..... 72/348; 72/336

[58] Field of Search ..... 72/329, 336, 348, 354

[56] References Cited

U.S. PATENT DOCUMENTS

| | | | |
|---|---|---|---|
| 368,821 | 8/1887 | Edmands | 72/348 |
| 2,239,897 | 4/1941 | Lyon | 72/348 |
| 3,902,347 | 9/1975 | Ridgway et al. | 72/336 |
| 4,109,599 | 8/1978 | Schultz | 113/121 |
| 4,567,746 | 2/1986 | Bachmann et al. | 72/348 |
| 4,571,978 | 2/1986 | Taube et al. | 72/349 |
| 4,587,825 | 5/1986 | Bulso, Jr. et al. | 72/329 |
| 4,587,826 | 5/1986 | Bulso, Jr. et al. | 72/329 |

*Primary Examiner*—Lowell A. Larson
*Attorney, Agent, or Firm*—Reese Taylor

[57] ABSTRACT

A method of forming container end panels includes first forming the bottom outer panel and then preliminarily forming the chuckwall and countersink radius by pulling material from the peripheral edge area with a punch core. The countersink radius is finally formed by partially retracting the punch core from the radius while holding the chuckwall to wrap some of the material in the radius upwardly. The apparatus includes an outer punch core with a tapered nose which preliminarily forms the chuckwall and countersink radius and then is retractable from the radius while holding the wall during final forming of the radius.

10 Claims, 10 Drawing Figures

METHOD AND APPARATUS FOR FORMING CONTAINER END PANELS

FIELD OF THE INVENTION

This invention relates, in general, to forming container end panels or "shells" for closing the ends of two or three piece containers, and relates in particular to a unique method and apparatus for forming the bottom center panel of the shell prior to forming the countersink radius and chuckwall so as to avoid pulling material from the center panel during formation of the chuckwall and countersink radius.

Metal containers or cans of both two and three piece construction are well-known in the art with the containers primarily being used for food and beverages, but, of course, having utility for other products as well.

These containers are generally closed at their ends with end panels or "shells", as they are commonly known. In the two piece construction, only one shell is required while in the three piece construction, two are required. In either case, these end panels or shells generally comprise a bottom center panel and a seaming flange peripherally outboard thereof, and interconnected to the bottom panel by frusto-conical walls terminating in a countersink radius.

The frusto-conical walls form a seat for the seaming chuck on the outermost wall which is commonly called a "chuckwall" since it is intended to engage the seaming chuck. The countersink radius is also of considerable significance in that it is the countersink radius area which provides strength to resist buckling from pressures within the closed container.

It is, of course, advantageous to provide adequate strength in this area, and one of the difficulties commonly encountered in the prior art of metal drawing is that in forming the radiused area, the material is thinned during the drawing operation as it is pulled around appropriate tooling.

One obvious solution to this problem is to start with material which is overguage so as to compensate for the thinning which normally occurs during such forming. The result, however, is that metal is wasted since the end product contains excess metal in certain areas in order to obtain adequate metal in the critical area.

Other solutions to the problem can be seen in Bulso U.S. Pat. Nos. 4,587,826 and 4,587,825, wherein various expedients are disclosed for providing the necessary tight radius without undue metal thinning wherein an overlength chuckwall is initially formed and then shortened to form the final wall length and radius.

Further approaches to end panel forming can be seen in Schultz U.S. Pat. No. 4,109,599 and Taube U.S. Pat. No. 4,571,978 wherein various methods for producing an annular groove or reinforcing channel are disclosed. Taube, for example, discloses forming the radius area and chuckwall in a completely unrestrained fashion.

Most solutions involve either forming the chuckwall and countersink radius initially followed by forming the bottom panel or performing these operations simultaneously.

Material savings and strength are, or course, the motivating factors with regard to the methods illustrated in these patents, and are also a primary motivating factor in the method and apparatus disclosed in this application.

Thus, while the solutions just referred to are presumably operable, it is felt that both material savings and the desired operational results are obtainable by reversing the normal sequence.

SUMMARY OF THE INVENTION

It has, therefore, been found that adequate strength can be provided in the countersink area by providing a method of forming a container wherein the bottom panel is formed first following which the flange area is held to control and metal while the countersink radius is formed by pulling material from the flange or peripheral area instead of from the bottom panel.

It has been found that this method can be facilitated by providing an inner and outer punch core with the outer punch core having a tapered wall on the outer surface and a straight wall on the inner surface with these walls terminating in a radiused end which projects ahead of the inner punch core so as to preliminarily form the countersink area. Retraction of the inner and outer punch cores provides holding force by the straight inner surface of the outer punch core against the peripheral surface of the die core on the inner frusto-conical wall of the shell while the material is wrapped back on itself to tighten the radius. In this way, the metal is not traveled against itself and thinning is eliminated. Also, since the outer surface of the outer punch core is tapered, it pulls away from holding engagement during this movement and permits the metal to be drawn from the flange area.

Accordingly, production of an improved method and apparatus for carrying out the method fo forming the end panel becomes the principal object of this invention with other objects thereof becoming more apparent upon the reading of the following brief specificaiton considered and interpreted in view of the accompanying drawings.

OF THE DRAWINGS

DESCRIPTION OF THE PREFERRED EMBODIMENTS

It will first be noted that the method and apparatus of the present invention would normally be utilized in conjunction with a double-acting press, having an inner ram 10 and outer ram 20, movable toward and away from a base 60. The press has not been described in great detail herein since such presses, as exemplified in Ridgway U.S. Pat. No. 3,902,347, are well-known in this art. These presses have the capability of independently controlling the movement of their rams and the tooling associated therewith.

Figure 1:
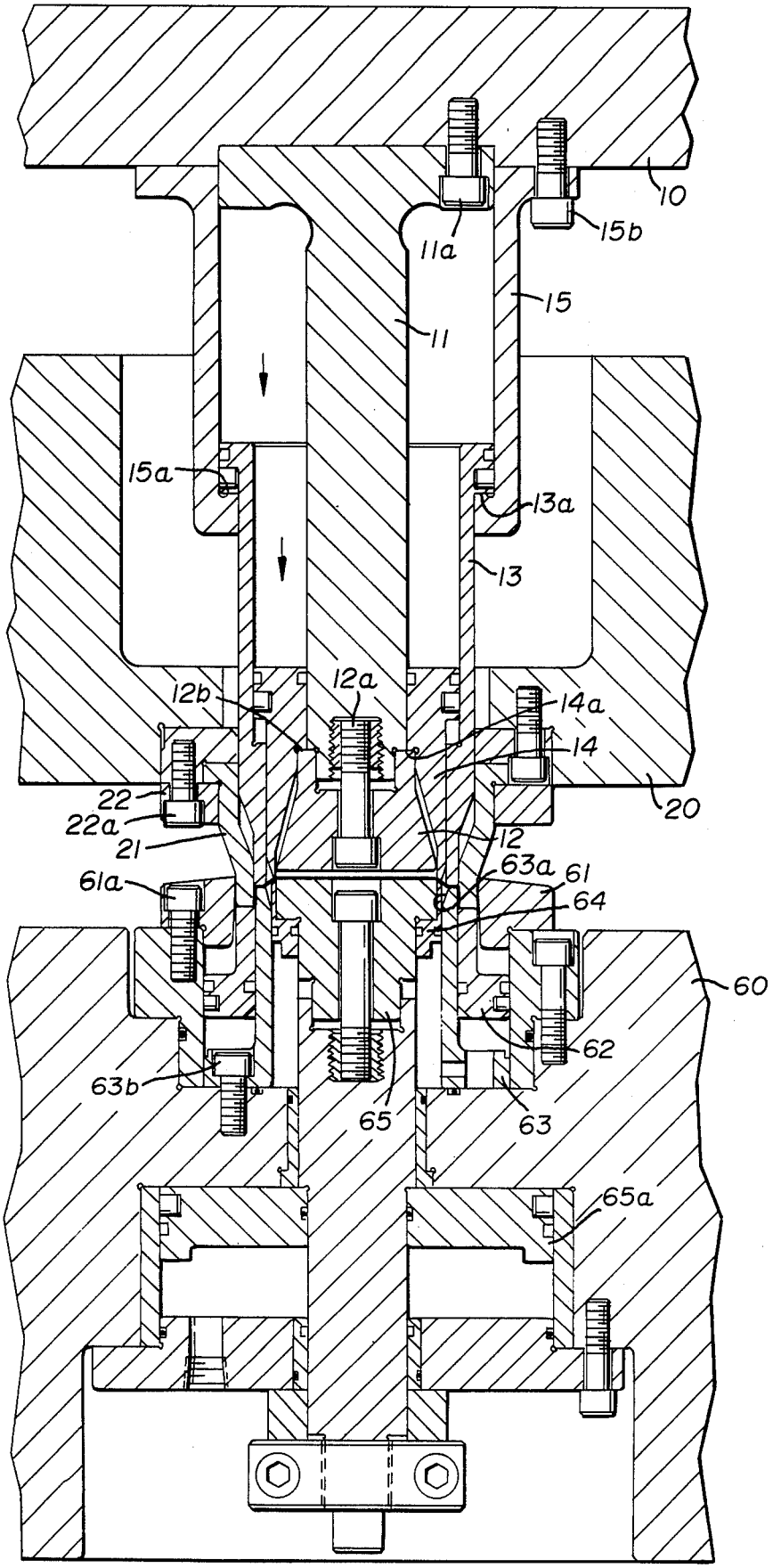
FIG. 1 is an elevational view, in section, showing an assembly of the overall apparatus necessary to carry out the method.
Figure 2:
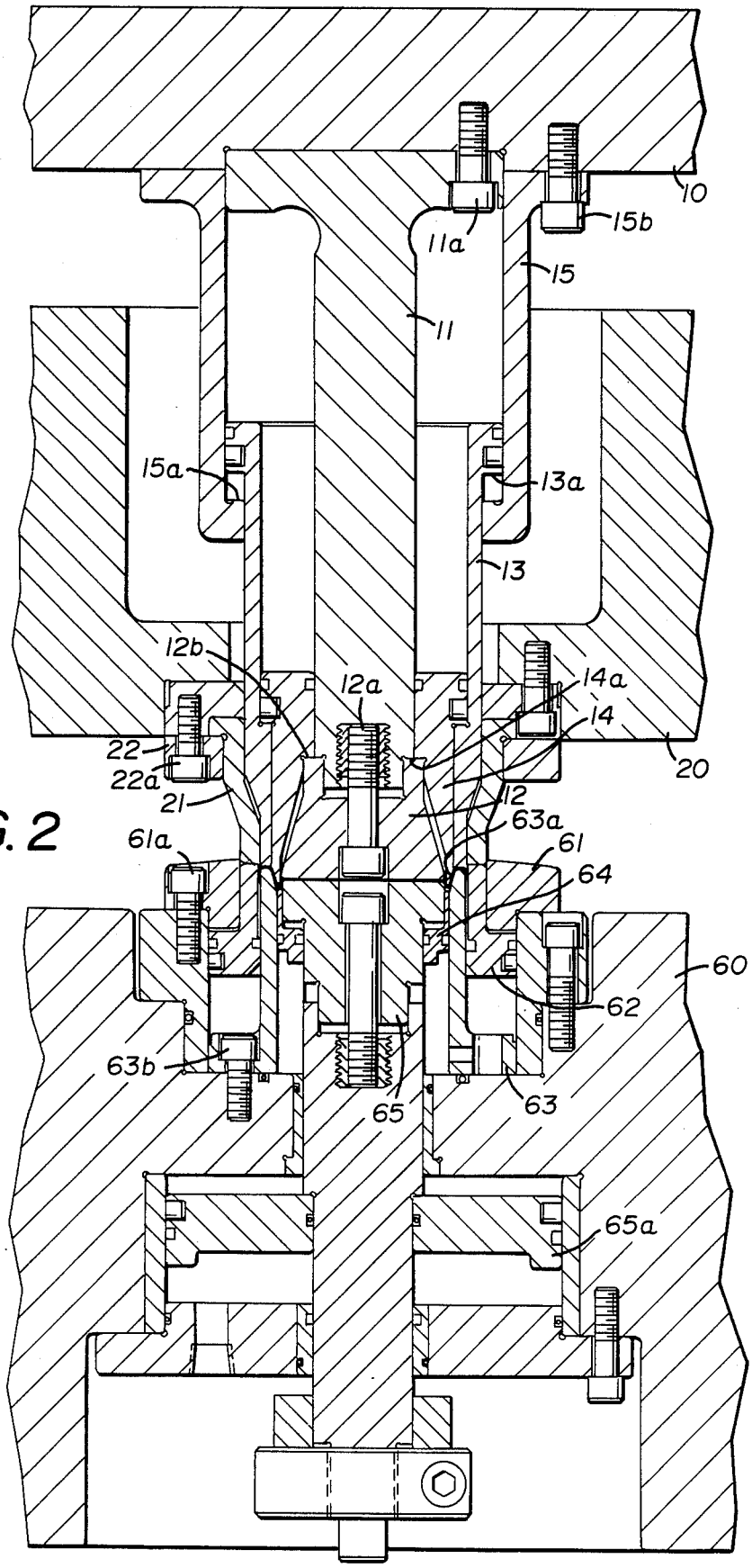
FIG. 2 is a similar elevational view, in section, showing the apparatus at a different stage of operation.
Figure 3:
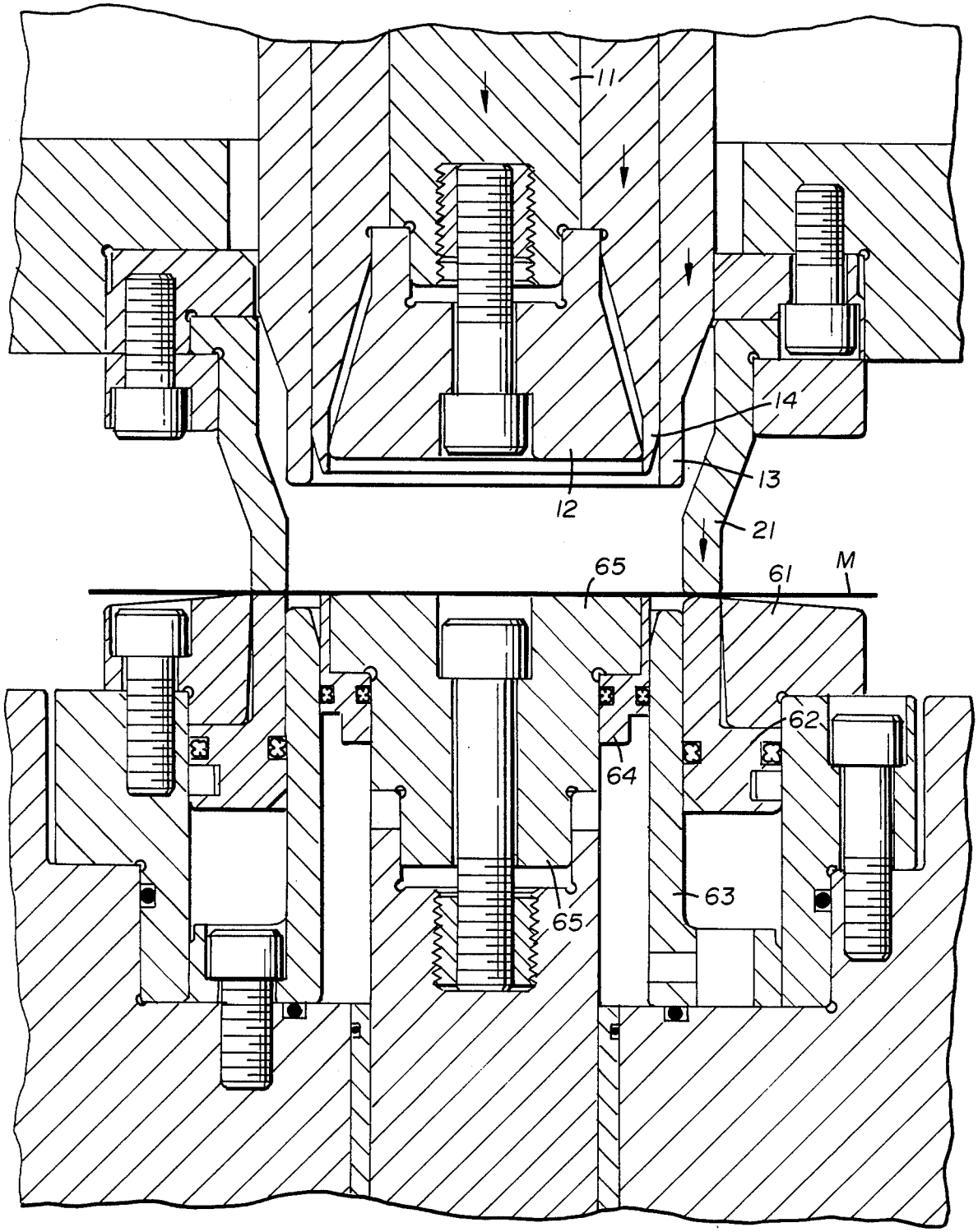
FIGS. 3 through 9 are enlarged sectional views showing the apparatus in various positions during the stages of forming with FIG. 5 corresponding with the assembly view of FIG. 1, while FIG. 7 corresponds with the assembly view of FIG. 2.

Referring then, specifically, to FIGS. 1 and 2 of the drawings for a detailed description of the apparatus, it will be noted that the inner ram 10 carries a punch core riser 11 affixed thereto with one or more screws **11*a*, and carrying, on its distal end, an inner punch core 12 adjustably secured thereto by the screw 12***a*.

A fluidly actuated outer punch core 14 is also carried by inner ram 10 in concentric relationship with the punch core riser 11 and the inner punch core 12.

Further outboard, and still concentriclaly disposed, is a first pressure sleeve 13 which is also fluidly actuated and is recirpocal within a retainer 15 which is secured to the inner ram 10 by one or more screws 15*b*. It will be noted that outer punch core 14, which is fluidly actuated, is reciprocally movable within a cylinder formed by first pressure sleeve 13 and punch core riser 11 and that its downward travel is limited by shoulder 12*b* of inner punch core 12. However, it will also be noted that the relative dimensions of the inner and outer punch cores are such that outer punch core 14 extends beyond inner punch core 12.

The outer ram 20 carries a punch shell 21 held in place by a retainer 22 and one or more retaining screws 22*a*. The punch shell is disposed outwardly of the inner and outer punch cores 12 and 14 and the first pressure sleeve 13, and in generally concentric relationship therrewith.

Carried on the base 60, which is disposed opposite inner and outer rams 10 and 20, is a cut edge 61 secured thereto by one or more screws 61*a*. Inboard from the cut edge 61 is a second pressure sleeve 62 which is fluidly supported on the base 60 for reciprocal movement with respect thereto. Pressure sleeve 62 is disposed in opposed relation with punch shell 21.

Still further inboard of pressure sleeve 62 is a die core ring 63 which is fixed to the base 60 by one or more screws 63*b* and disposed opposite first pressure sleeve 13 and partially opposite outer punch core 14.

Still further inboard of die core ring 63 is a concentric knockout piston 64 which is fluidly supported and actuated and finally, still further inboard is a die core 65 which is reciprocal with respect to the base 60 by means of the piston 65*a*.

It will be noted that the relative dispostion of the components just described has some significance and in that regard, it will be noted that the punch shell 21 is disposed in opposed relationship to the second pressure sleeve 62, while the first pressure sleeve 13 is disposed in generally opposed relationship to the die core ring 63. The inner punch core 12 is in generally opposed relationship to the die core 65, while the outer punch core 14 is configured so that it is insertable between the periphery of the die core 65 and the inner surface of the die core ring 63, as will be described in greater detail below.

Figure 5:
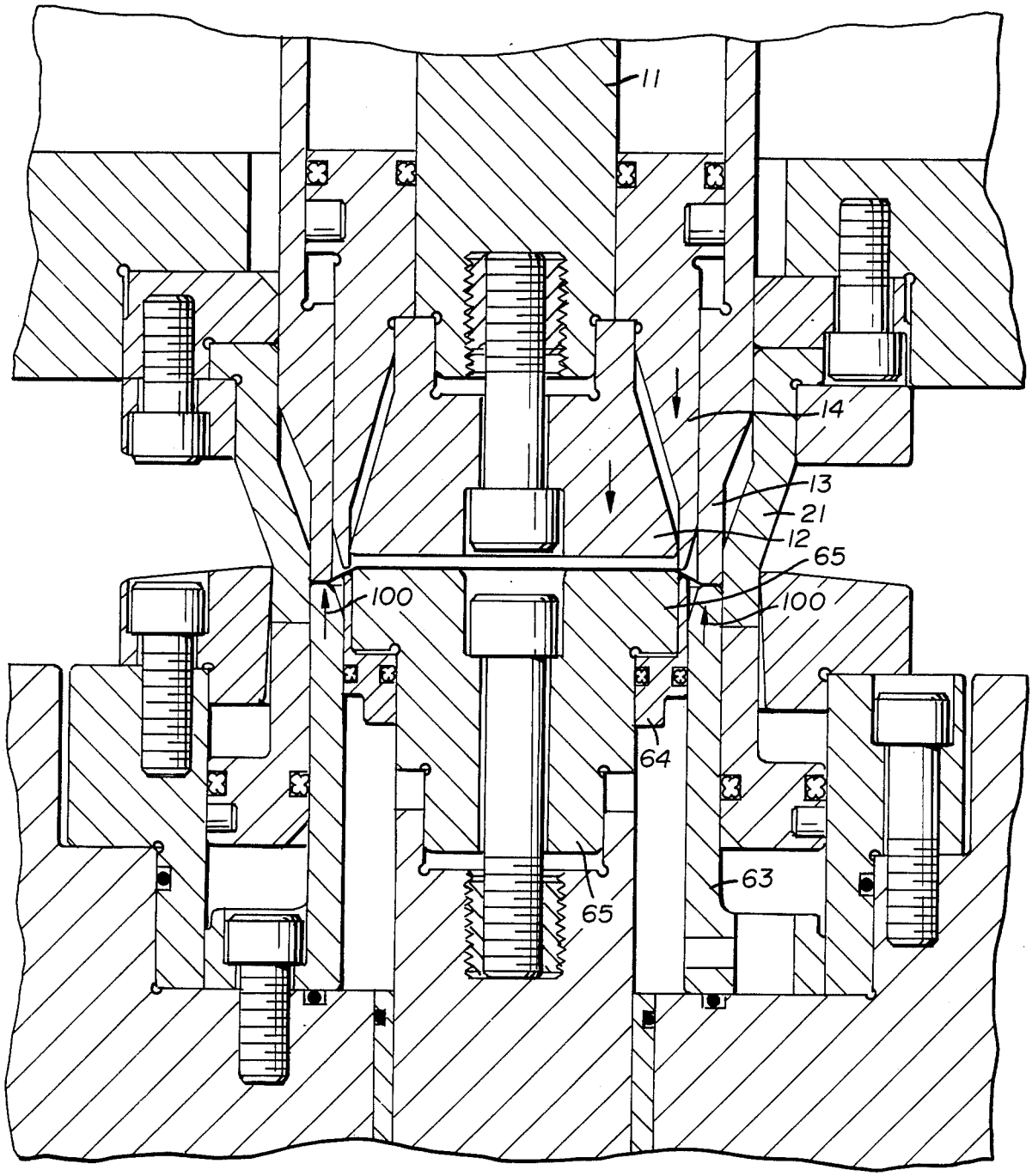
Figure 7:
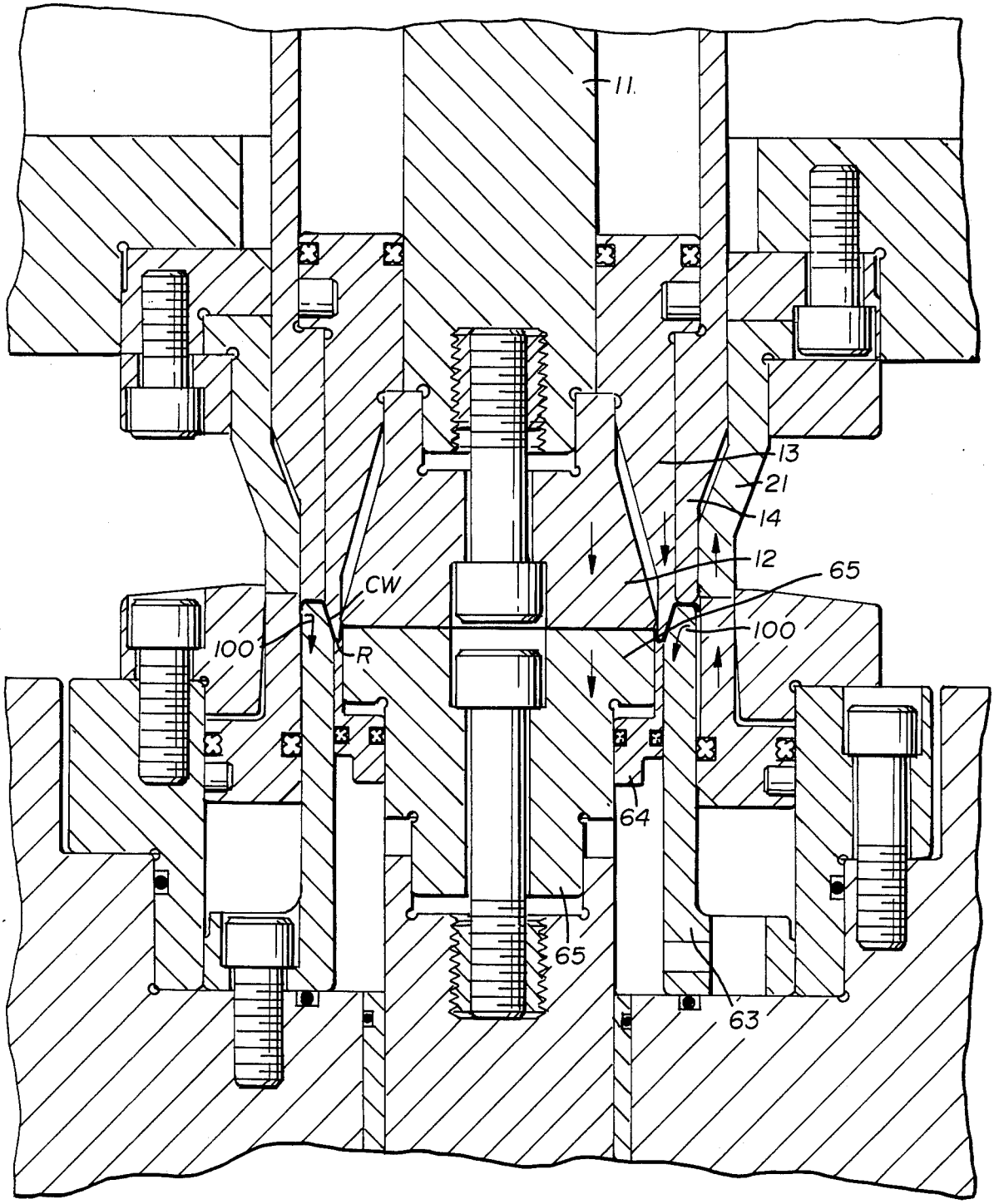

It also will be noted, with reference to the assembly views of FIGS. 1 and 2, that the tooling positioning illustrated in FIG. 1, generally corresponds to the enlarged view of FIG. 5, while the tooling positioning of FIG. 2 generally corresponds to the enlarged view of FIG. 7.

Referring next then to FIGS. 3 through 9 for a description of the operation of the apparatus, it will first be assumed that a suitable piece of material, either in sheet or coil form, has been inserted into the opening of the press. This material is generally designated in FIG. 3 by the letter M.

The press is then activated so that the punch shell 21 is brought into contact with the material M by movement toward the base 60, as clearly illustrated by the arrows in the drawings.

Figure 4:
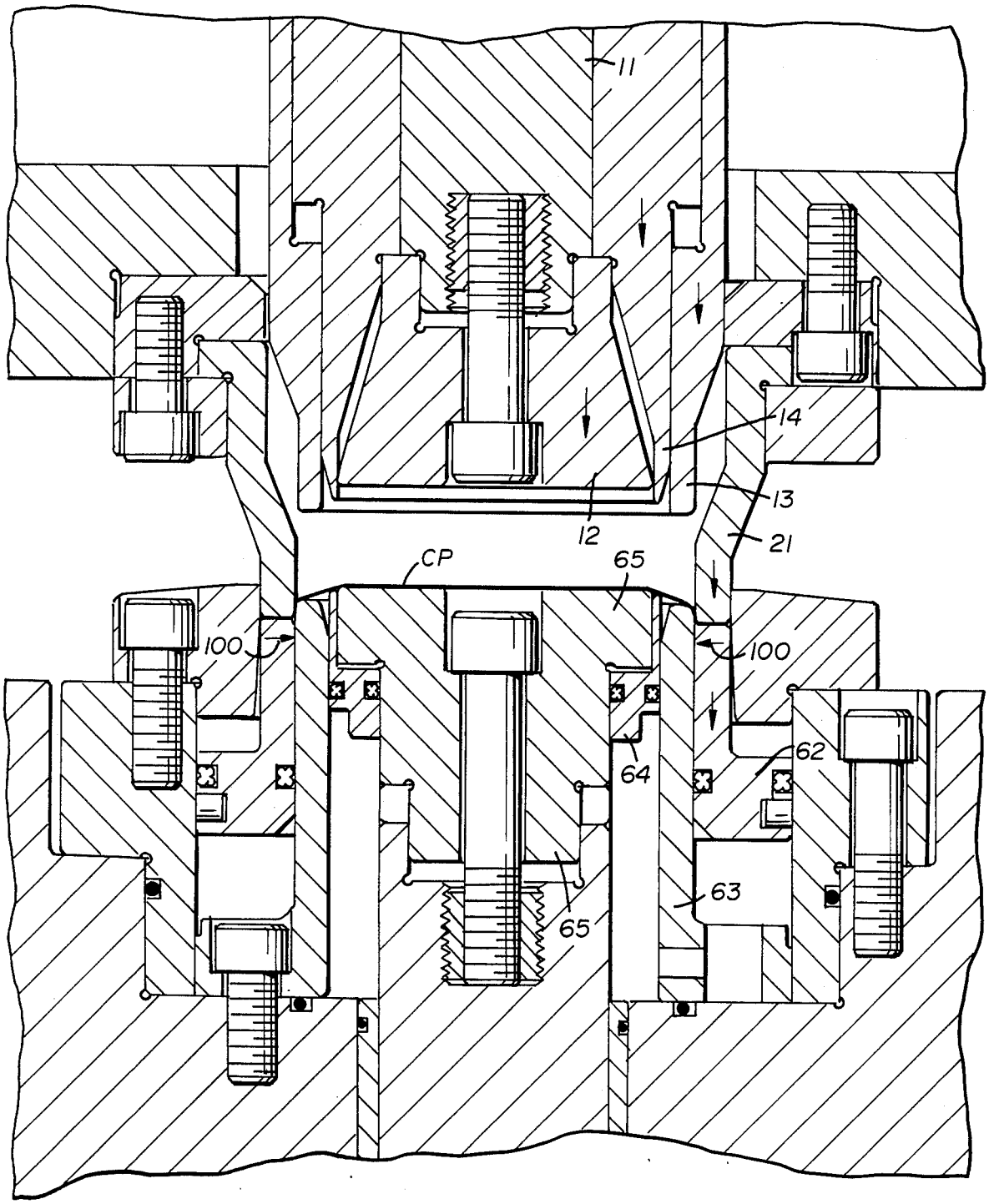

Further movement of punch shell 21 toward base 60 results in blanking the material against the cut edge 61 and, with reference to FIG. 4, it will be seen that as the punch shell 21 proceeds downwardly, it pushes the second pressure sleeve 62 out of the way, overcoming the fluid support for that sleeve. The material, at this stage, flows from the peripheral edge in the direction of the arrows 100, and the bottom, center panel CP is beginning to be formed over die core 65.

Referring to FIG. 5 of the drawings, it will be seen that as punch shell 12 continues toward base 60, it wipes the peripheral edge of the material M over the top of die core ring 63 to form an inverted cup. The first pressure sleeve 13 has now engaged the material and is holding pressure on it against the top of the die core ring 63 so as to control the metal flow which is again in the direction of arrows 100.

At this time, also, the inner and outer punch cores 12 and 14 have advanced toward the base 60. As already noted, the projecting nose of the outer punch core 14 is in advance of the nose of the inner punch core 12 and is just about, in FIG. 5, to engage the material M.

Figure 8:
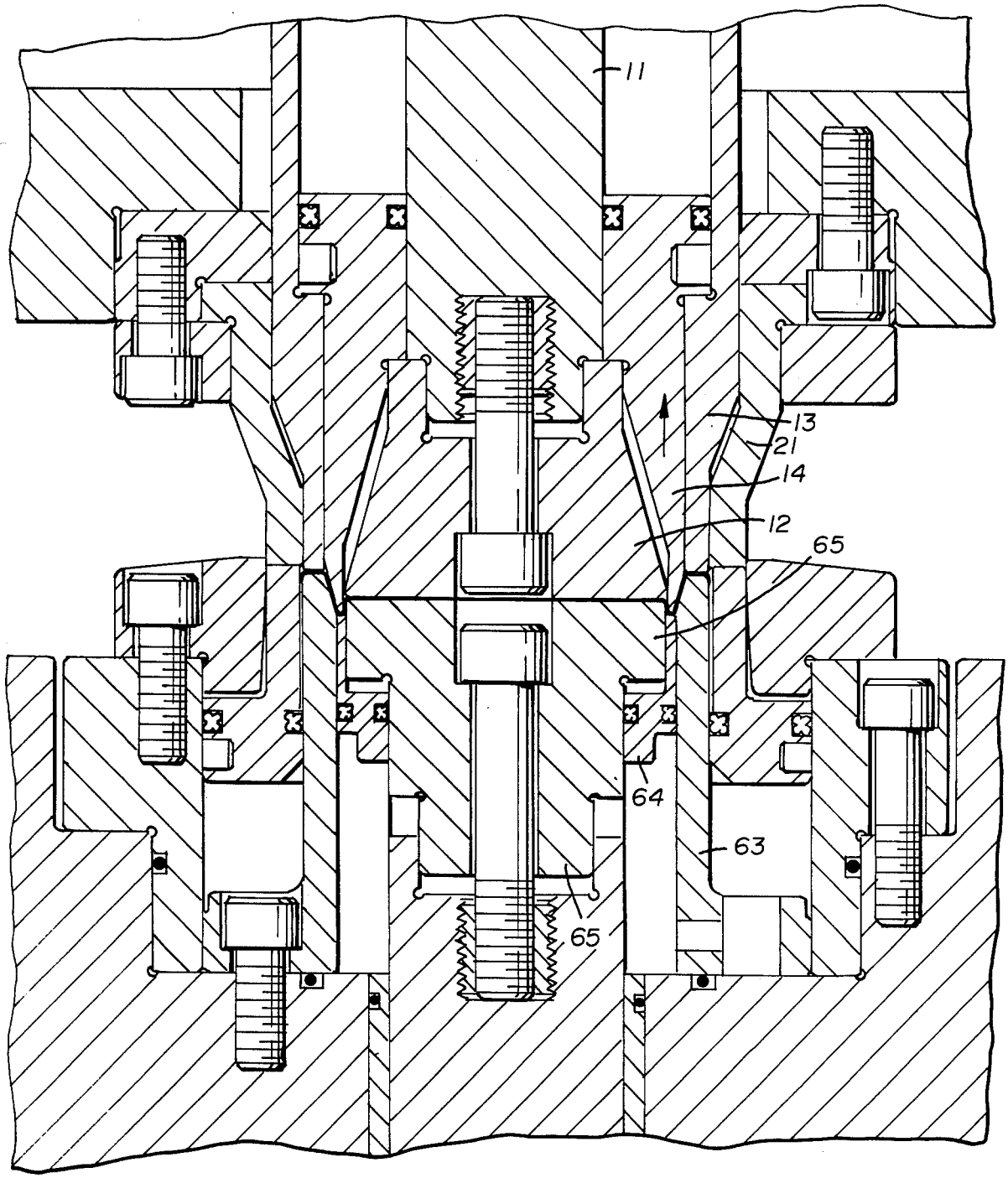
Figure 8A:
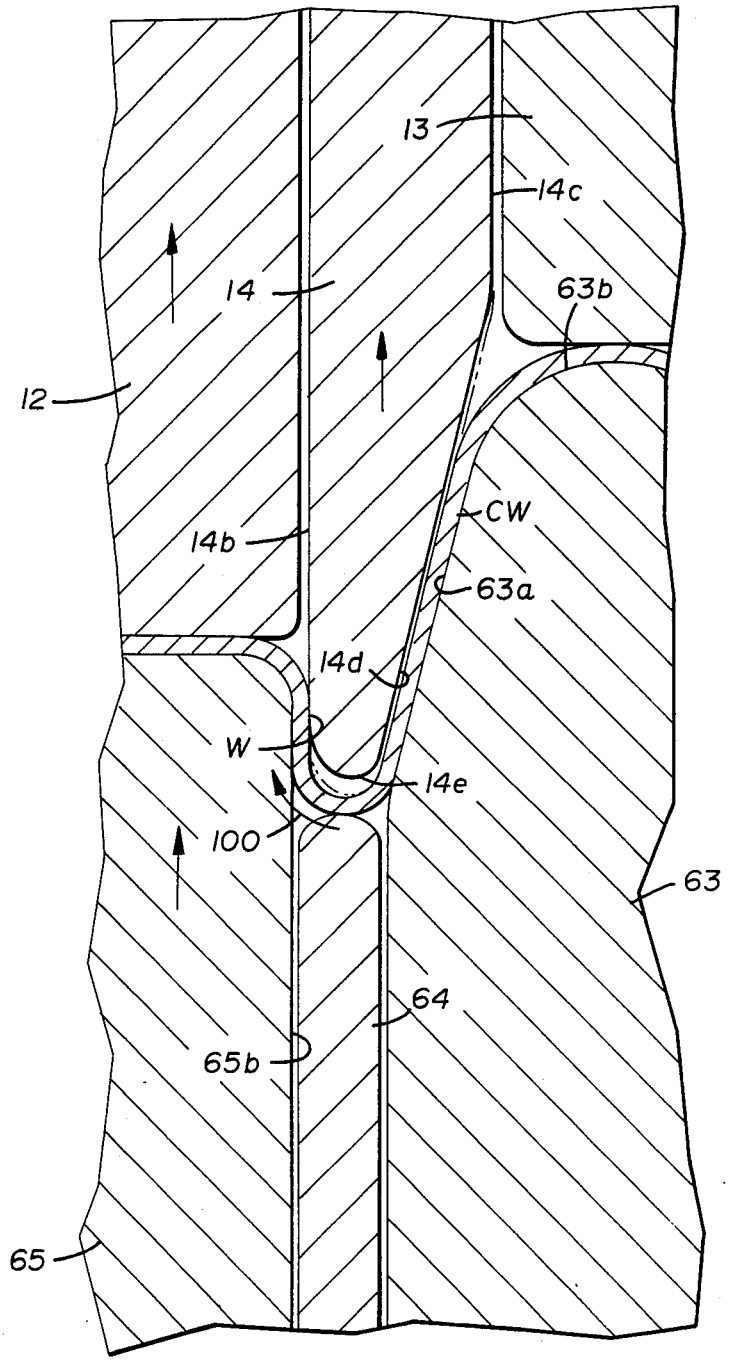
FIG. 8A is an enlarged sectional view showing the position and movement of the tooling at the critical, wrapping stage.
Figure 9:
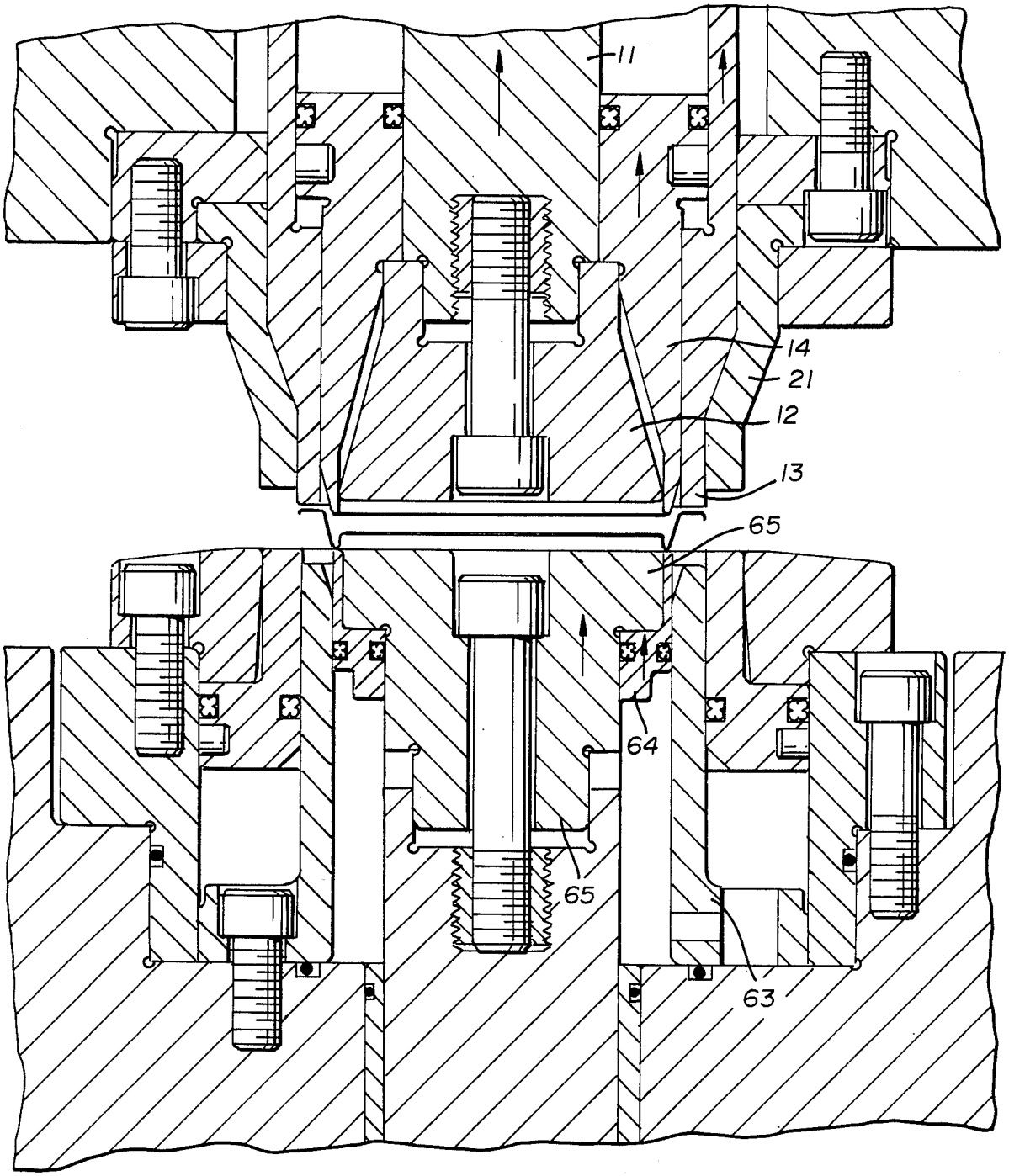

At this point, reference should be had to FIGS. 1, 2 and 8A wherein the enlarged view permits better understanding of the configuration of the lower nose of the outer punch core 14 and the upper nose of the die core ring 63.

In that regard, it will be seen that the outer punch core 14 has inner and outer wall surfaces 14*b* and 14*c*, respectively. The outer wall surface 14*c* tapers downwardly and inwardly from a point spaced from the ultimate end or nose of the outer punch core 14, so as to form a tapered wall 14*d* which leads tangentially to the radiused end 14*e*. The inner wall surface 14*b* continues in a straight path to the radiused end 14*e*.

The die core ring 63 also has a tapered wall 63*a* which tapers outwardly and upwardly, from a point spaced from its upper end or nose 63*b*, with the taper being roughly complemental to the taper on the wall 14*d* of the outer punch core 14*c*.

These configurations permit the radiused end 14*e* of the outer punch core 14 to enter the space between die core ring 63 and die core 65 as will be seen in FIG. 8A.

Figure 6:
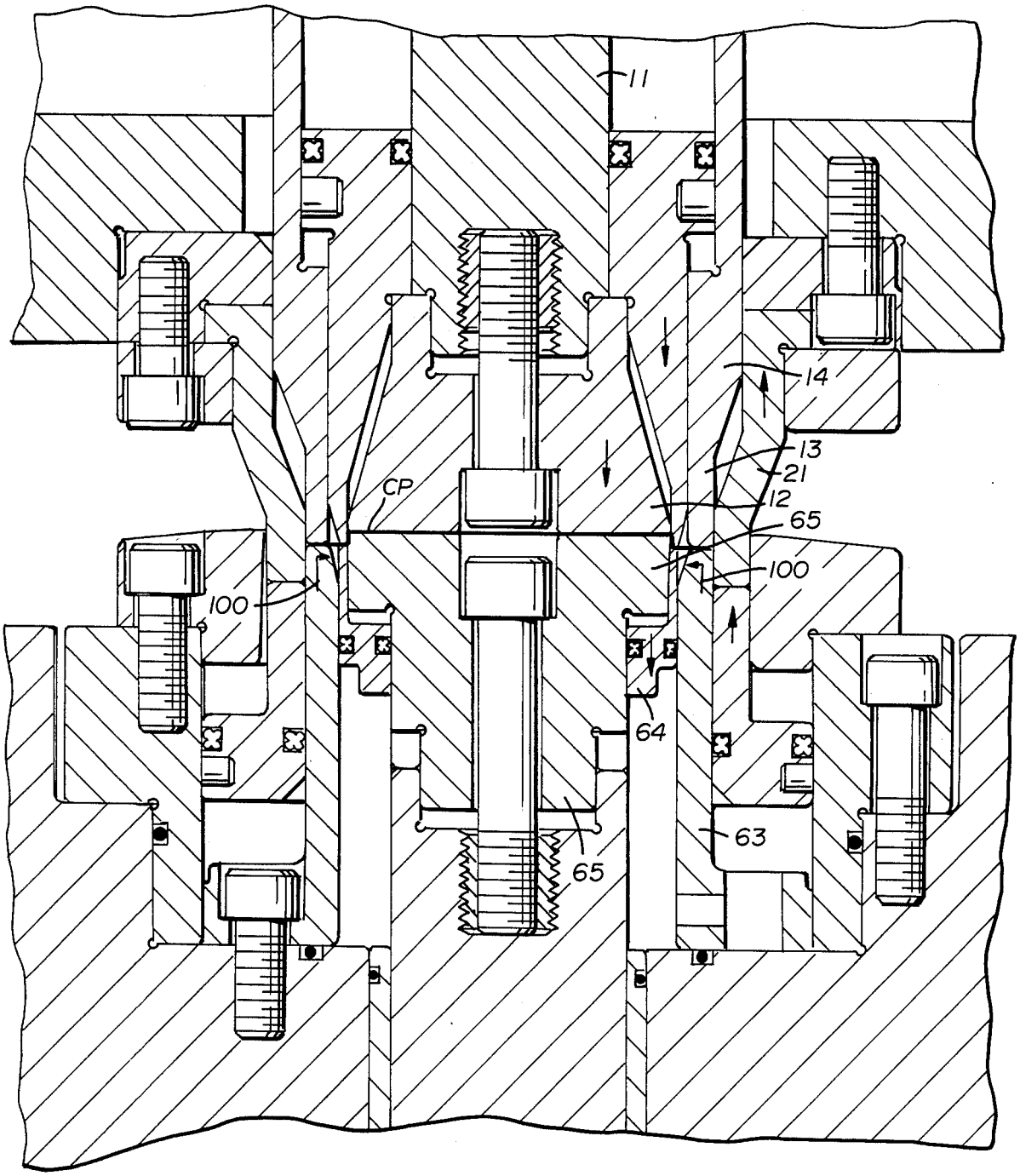

Returning then to the sequence of operations and, in particular, to FIG. 6, it will be noted that the first pressure sleeve 13 and outer punch core 14 have advanced to a position in which the center panel CP has now been formed over die core 65. It will be noted that this center panel is now fully formed and will not be affected by the ensuing operations. It will also be seen from arrows 100 that the material flow during the transformation from the FIG. 5 position to the FIG. 6 position has been up the outside of the die core ring 63 and across the top thereof.

At this point, then, the bottom panel CP is set and a peripheral edge portion, consisting of a stepped cross-sectional configuration, exists outboard of bottom center panel CP. It will also be noted that the inner punch core 12 is now contacting the material and holding it against the top of the die core 65, and further that the knockout piston 64 has been pushed downwardly by the movement of the outer punch core 14, overcoming the fluid support therefor. At this point, also, the depth of the center panel CP is within a few thousandths of an inch of its final depth.

Referring next to FIG. 7, it will be noted that the first pressure sleeve 13 is holding a peripheral section of the end piece against the top of the die core ring 63. Further advancement of the outer punch core 14 forms the chuckwall CW between outer surface 14*d* of outer punch core 14 and tapered wall 63*a* of die core ring 63 and perliminarily forms the countersink radius R in the space between the die core 65 and the die core ring 63. In this operation, material will flow in the direction of the arrows 100 or, in other words, out of the peripheral section with the bottom center panel CP being unchanged.

It will also be noted, at this point, that radius R is about 0.005 larger than its final dimension with this dimension being controlled by the size of the end 14*e*.

At this point, reference to FIG. 8A will again be of some assistance. It will be noted that FIG. 8A essentially shows the tooling positioning at the next stage from FIG. 7, but it will be illustrative, in view of its larger scale, in illustrating how the chuckwall CW is formed by the outer tapered wall surface 14*d* of the outer punch core 14 against the tapered wall 63*a* of the die core ring 63, and further how the straight inner wall 14*b* of the outer punch core 14 against the tapered wall 63*a* of the die core ring 63, and further how the straight inner wall 14*b* of the outer punch core 14 has formed a wall W in the end panel essentially straight against the outer peripheral surface of the die core 65.

Referring, then, next to FIG. 8 and to FIG. 8A, it will be seen how the final radius is set.

Accordingly, it will be noted that the inner ram 10 will have started its lift-off, pulling away from the base 60. At the same time, the die core 65 will follow it in an upward direction by action of piston 65*a*.

Reference to FIGS. 1 and 2 will disclose that a radially extending shoulder 12*b* is formed on the top of the inner punch core 12. A corresponding inwardly diverted shoulder 14*a* is formed on the outer punch core 14. Therefore, as the inner ram 10 pulls away, taking with it the inner punch core 12 which is fixed thereto, it will pick up the outer punch core 14 when the shoulders 12*b* and 14*a* engage. However, the outer punch core 14 will maintain contact with the straight wall of the material M with its straight inner wall 14*b* holding the material against the straight outer wall 65*b* of the die core 65, so that holding pressure is maintained in that area during at least a portion of the upward travel of the tooling. This minimizes any tendency to pull material from center panel CP.

However, the radiused nose 14*e* of the outer die core 14 will pull out of the radius R of the shell and cause a wrapping action of the material as die core 65 and inner punch core 12 move upwardly in the direction of the arrows. Tapered outer wall surface 14*d* will also pull away from tapered wall 63*a* on the die core ring permitting material flow out of the flange area. However, holding pressure is still maintained by first pressure sleeve 13 against die core ring 63 to control this flow. The wrap will pull the material from the full-line position of FIG. 8A to the broken line position thereof with the metal wrapping in the direction of the arrow 100. In this way, the radius will be tightened up to its final desired dimension without any thinning due to the fact that the material is not working against itself during this operation.

Referring next, then, to FIG. 9 and again to FIGS. 1 and 2, it will be seen that the retainer 15 has a shoulder 15*a* thereon and first pressure sleeve 13 also has shoulder 13*a*, so that as the inner ram moves upwardly still further to the position in FIG. 9, these shoulders pick up on each other and the entire tooling is pulled away from the base 60 so that the knock-up piston 64, working with the die core 65, raises the finished end piece to the position of FIG. 9 from which position it can then be removed from the press, or transferred to another station within the press, for further operations.

While a full and complete description of the invention has been set forth in accordance with the dictates of the Patent Statutes, it should be understood that modifications can be resorted to without departing from the spirit hereof or the scope of the appended claims.

What is claimed is:

1. A method of forming a container end panel from a blank of material comprising the steps of:

(A) forming a cup-shaped member having a formed bottom panel and an annular peripheral section; and (B) holding a portion of said peripheral section and forming a countersink radius adjacent said bottom panel by pulling material from said peripheral section.

2. The method of claim 1 wherein said bottom panel is formed by engaging a central section of the blank between an inner punch core and a die core and wiping a radially outboard section over said die core by advancing an outer punch core and a concentrically disposed punch shell.

3. The method of claim 2 wherein said coutnersink radius is formed at least partially by advancing said outer punch core ahead of said inner punch core while holding a radially outboard area of said peripheral section between said punch shell and an opposed pressure sleeve.

4. The method of claim 3 wherein said countersink radius is finally set by retracting said outer punch core, said inner punch core and said die core with said outer punch core retracting slightly in advance of said inner punch core and said die core.

5. The method of claim 4 wherein a chuckwall is formed between said countersink radius and said peripheral section; said outer punch core holding said chuckwall against said die core during a portion of the retracting travel of said inner and outer punch cores and said die core.

6. Apparatus for forming a container end panel having a central bottom panel, a peripheral flange and chuckwall and coutnersink radius interconnecting said flange and said bottom panel, comprising:

(A) an inner punch core;

(B) an outer punch core disposed in concentric relationship with said inner punch core;

(C) a first pressure sleeve disposed in concentric relationship with said outer punch core;

(D) a punch shell disposed in concentric relationship with said outer punch core;

(E) a die core disposed in opposed relationship with said inner punch core;

(F) a fixed die core ring disposed in opposed relationship with said first pressure sleeve; and (G) a second pressure sleeve disposed in opposed relationship with said punch shell.

7. The apparatus of claim 6 wherien said outer punch core has a narrowed, projecting end portion tapering from its outer wall toward its inner wall; and said die core ring has a narrowed, projecting end portion tapering from its inner wall toward it souter wall.

8. The apparatus of claim 7 wherein said punch shell is movable toward said second pressure sleeve while said die core is held stationary to form said central bottom panel.

9. The apparatus of claim 8 wherein said outer punch shell is movable ahead of said inner punch shell to preliminarily form said countersink radius and said chuck-wall in cooperation with said die core ring.

10. The apparatus of claim 9 wherein said inner punch core and said die core are retractable; and said outer die core is retractable with said inner punch core.

* * * * *